US008216013B1

(12) United States Patent
Ellis

(10) Patent No.: US 8,216,013 B1
(45) Date of Patent: Jul. 10, 2012

(54) BODY SURFING ENHANCEMENT DEVICE AND ASSOCIATED METHODS

(76) Inventor: Dale E. Ellis, Deltona, FL (US)

( * ) Notice: Subject to any disclaimer, the term of this patent is extended or adjusted under 35 U.S.C. 154(b) by 223 days.

(21) Appl. No.: 12/646,433

(22) Filed: Dec. 23, 2009

Related U.S. Application Data

(60) Provisional application No. 61/143,917, filed on Jan. 12, 2009, provisional application No. 61/186,561, filed on Jun. 12, 2009, provisional application No. 61/246,345, filed on Sep. 28, 2009.

(51) Int. Cl.
*A63B 31/12* (2006.01)

(52) U.S. Cl. ..... 441/60

(58) Field of Classification Search ..... 441/55–64
See application file for complete search history.

(56) References Cited

U.S. PATENT DOCUMENTS

| | | | | |
|---|---|---|---|---|
| 1,252,619 | A * | 1/1918 | Russo | 441/60 |
| 1,671,324 | A | 5/1928 | Speziale | |
| 1,843,582 | A | 2/1932 | Schmitt | |
| 3,015,829 | A | 1/1962 | Gronkowski | |
| 3,078,482 | A | 2/1963 | Crowder | |
| 3,109,186 | A | 11/1963 | Glenn | |
| 3,428,980 | A * | 2/1969 | Newton | 441/55 |
| 5,013,271 | A | 5/1991 | Bartlett | |
| 5,015,208 | A | 5/1991 | Fox et al. | |
| 5,055,075 | A | 10/1991 | Waller, Jr. | |
| D329,633 | S | 9/1992 | Rodgers, Jr. | |
| 5,173,068 | A | 12/1992 | Dunn et al. | |
| D342,562 | S | 12/1993 | Micklatcher | |
| 5,326,296 | A * | 7/1994 | De Jesus | 441/60 |
| 6,048,237 | A | 4/2000 | Hopper | |
| 6,193,636 | B1 | 2/2001 | Chen | |
| 6,334,799 | B1 | 1/2002 | Delpozo et al. | |
| 6,364,727 | B1 | 4/2002 | Rangel | |
| D578,596 | S | 10/2008 | Hicks | |
| 2008/0020660 | A1 | 1/2008 | Barney | |
| 2008/0070458 | A1 | 3/2008 | Crough | |

FOREIGN PATENT DOCUMENTS

| | | | |
|---|---|---|---|
| JP | 2000167083 | A | 6/2000 |
| JP | 2006149447 | A | 6/2006 |

* cited by examiner

*Primary Examiner* — Lars A Olson
*Assistant Examiner* — Andrew Polay
(74) *Attorney, Agent, or Firm* — Brian S. Steinberger; Law Offices of Brian S. Steinberger, P.A.

(57) ABSTRACT

A device for enhancing body surfing includes fin elements affixable to a person's leg via a guide assembly affixable to a thigh, and each including and upper and a lower fin. The upper fin is rotationally positionable relative to the leg's longitudinal axis. The lower fin is longitudinally movable between a stowed position aligned with the upper fin and a deployed position beneath the upper fin. In use, a person can attach the fin elements to the belt rail, rotate the fin elements outward, and slide the lower fin downward into the deployed position, thereby creating an enhanced surface for body surfing. Another embodiment is provided that includes a unitary fin rotationally affixable to the leg and waist.

11 Claims, 16 Drawing Sheets

BODY SURFING ENHANCEMENT DEVICE AND ASSOCIATED METHODS

CROSS-REFERENCE TO RELATED APPLICATION

This application claims priority to provisional application Ser. No. 61/143,917, filed Jan. 12, 2009, Ser. No. 61/186,561, filed Jun. 12, 2009, and Ser. No. 61/246,345, filed Sep. 28, 2009, all of which are incorporated herein by reference.

BACKGROUND OF THE INVENTION

1. Technological Field

The device relates to sports equipment, and, more particularly, to surfing equipment, and, most particularly, to body surfing equipment.

2. Description of Related Art

It is known to use surfboards to support a person while "riding" a wave. It is also known to "body surf," that is, to ride a wave without the use of a surfboard, by stretching one's body out in as planar a configuration as possible and permitting oneself to be carried ashore by the wave.

However, body surfing is known to be quite difficult, especially in more rigorous conditions. Therefore, it would be beneficial to provide a device and method that enhances the body surfing experience.

SUMMARY

A device and method are provided for enhancing body surfing. The device comprises a left and a right fin element. Each of the fin elements is affixable to a respective left and right leg and waist of a person.

Each fin element comprises a guide assembly affixable to a thigh. Each guide assembly comprises an arcuate base and at least one guide element extending circumferentially around at least a portion of the base. The base is affixable to a front portion of the thigh, and each guide element comprises at least two fixation elements spaced apart circumferentially.

A belt rail has a track therein and is positionable adjacent a waist of the person.

An upper fin has a top edge positionable beneath a waist of the person. The upper fin is slidably affixable to the belt rail at or about the waist and hips of a person adjacent the top edge and is removably anchorable to at least two of the fixation elements. This permits upper fin rotational positioning relative to a longitudinal axis of the leg at a plurality of orientations thereto. At least one of the orientations comprises the upper fin's being substantially parallel to a torso plane of the person.

A lower fin is slidably engaged with the upper fin. The lower fin is longitudinally movable between a stowed position wherein a top edge thereof substantially aligns with the upper fin's top edge and a deployed position at least partially beneath the upper fin.

In use, a person can don the guide assembly and belt rail, and then attach the combined upper and lower fins to the belt rail and to one of the rotational fixation elements. When in a desired location, the person can then release the upper fin from the fixation element to which it is attached, rotate and re-attach the upper fin to another fixation element so that the fins are substantially in a body plane of the person, and then slide the lower fin downward into the deployed position, thereby creating an enhanced surface for body surfing.

In another embodiment, a device is provided for use in body surfing. The device comprises a left and a right fin element, each of which is affixable to a respective left and right leg of a person. Each device has a guide assembly that is affixable to a thigh of the leg. The guide assembly comprises an arcuate base and at least one guide element extending circumferentially around at least a portion of the base. The base is affixable to a front portion of the thigh. Each guide element comprises at least two fixation elements spaced apart circumferentially.

A belt rail having a track therein is positionable adjacent a waist of the person.

A fin having a top edge is positionable beneath the waist. The fin is slidably affixable to the belt rail adjacent the top edge and is removably anchorable to at least two of the fixation elements. This arrangement permits fin rotational positioning relative to a longitudinal axis of the leg at a plurality of orientations thereto. At least one of the orientations comprises the fin's being substantially parallel to a torso plane of the person for use in body surfing.

The fin has an inner edge having a top portion extending from the top edge. The top portion is substantially parallel to the outer edge. An arcuate bottom portion is adjacent the top portion and flares outward, so that a width along the top portion is greater than a width along the bottom portion.

It will be understood by one of skill in the art that the fin embodiments could be made of a rigid material, or alternatively could be made of a flexible material that could be made at least semi-rigid through the use, for example, of inflation. For example, ribs or some other stiffening element could be provided in support of one or more inflatable elements or sub-elements to achieve the spirit of the invention as described herein.

DETAILED DESCRIPTION OF THE PREFERRED EMBODIMENTS

Figure 1:
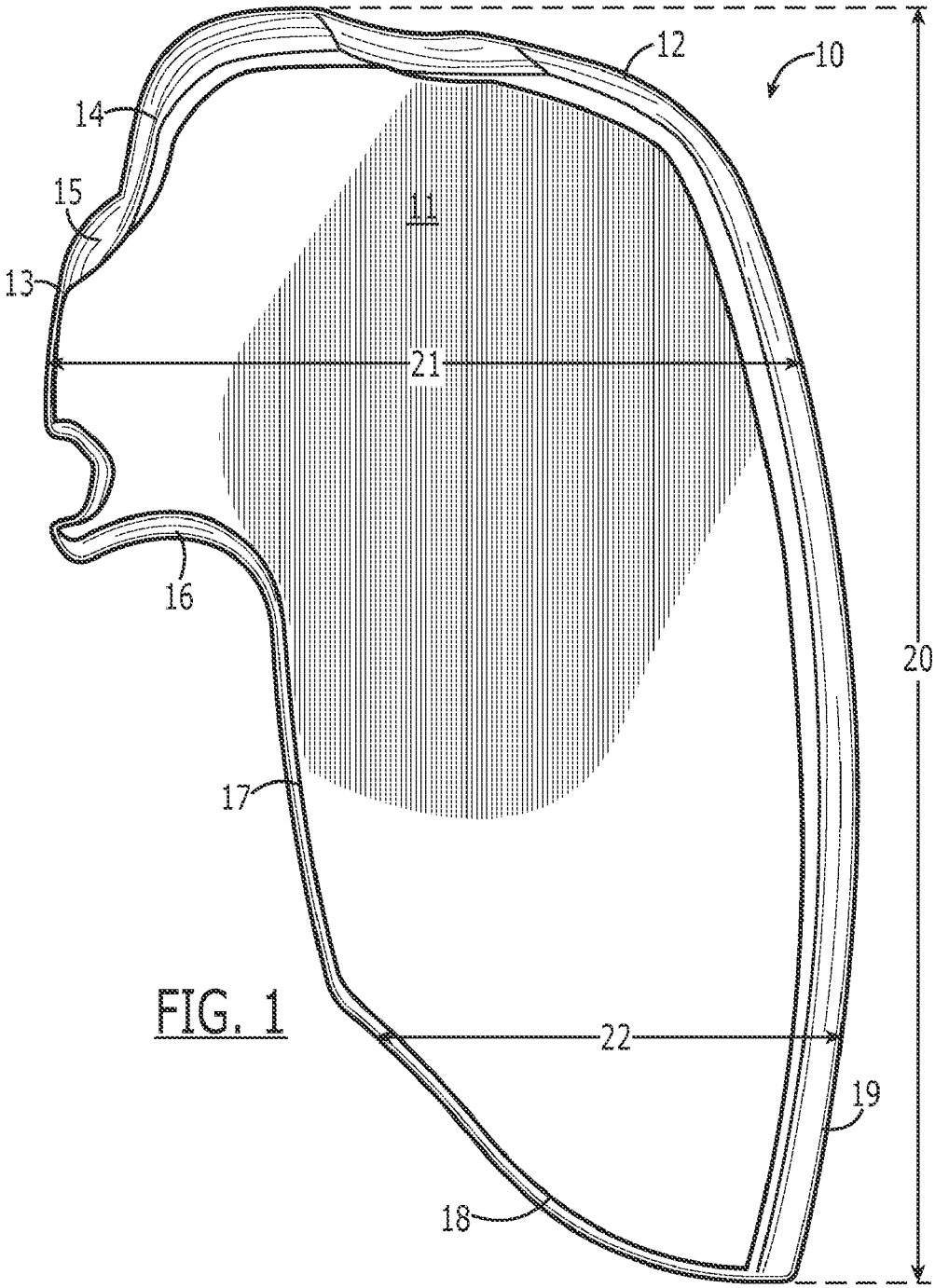
FIG. 1 is a front plan view of the body surfing enhancement device.
Figure 2:
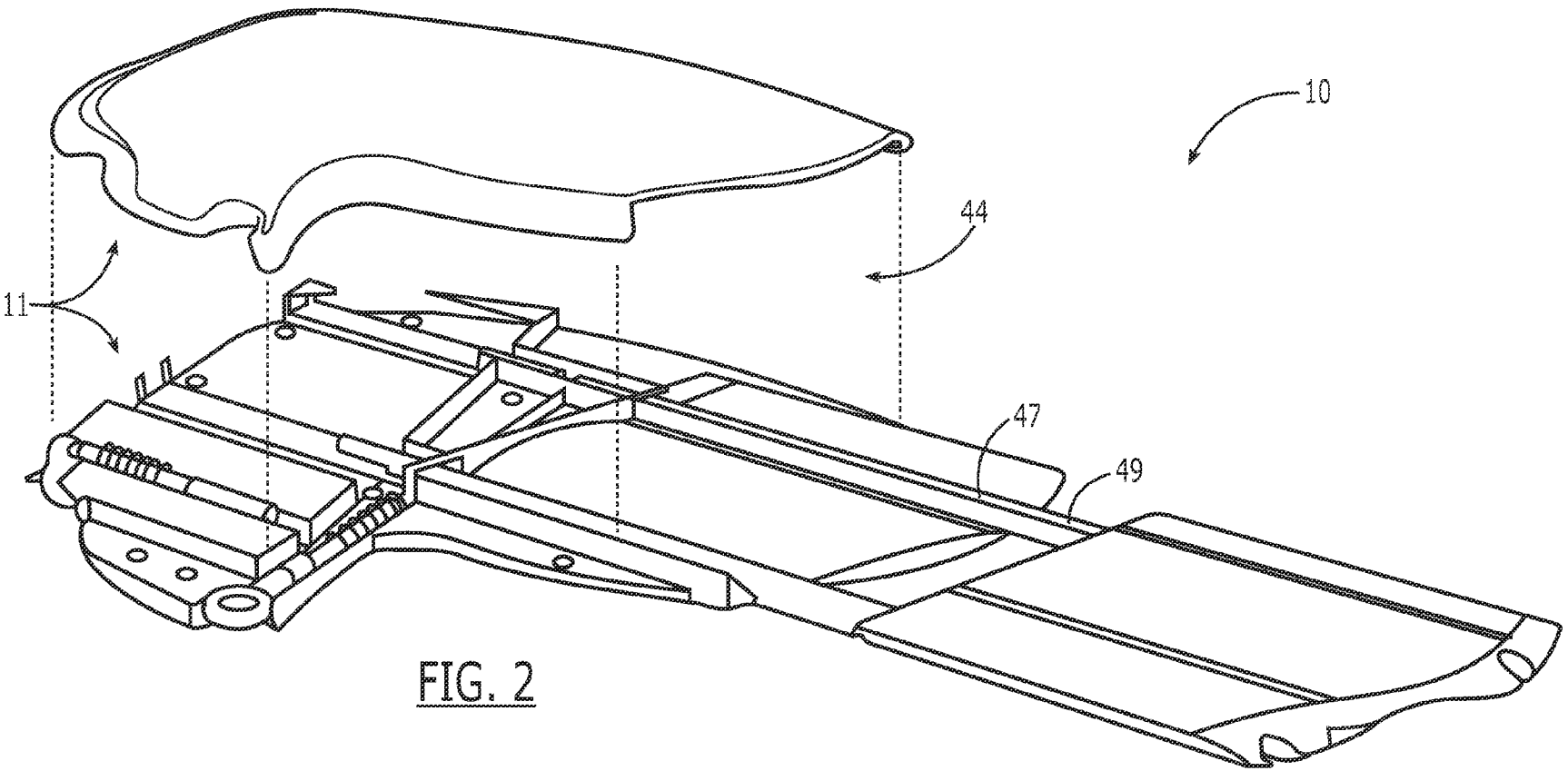
FIGS. 2 and 3 are exploded views of the device of FIG. 1.
Figure 3:
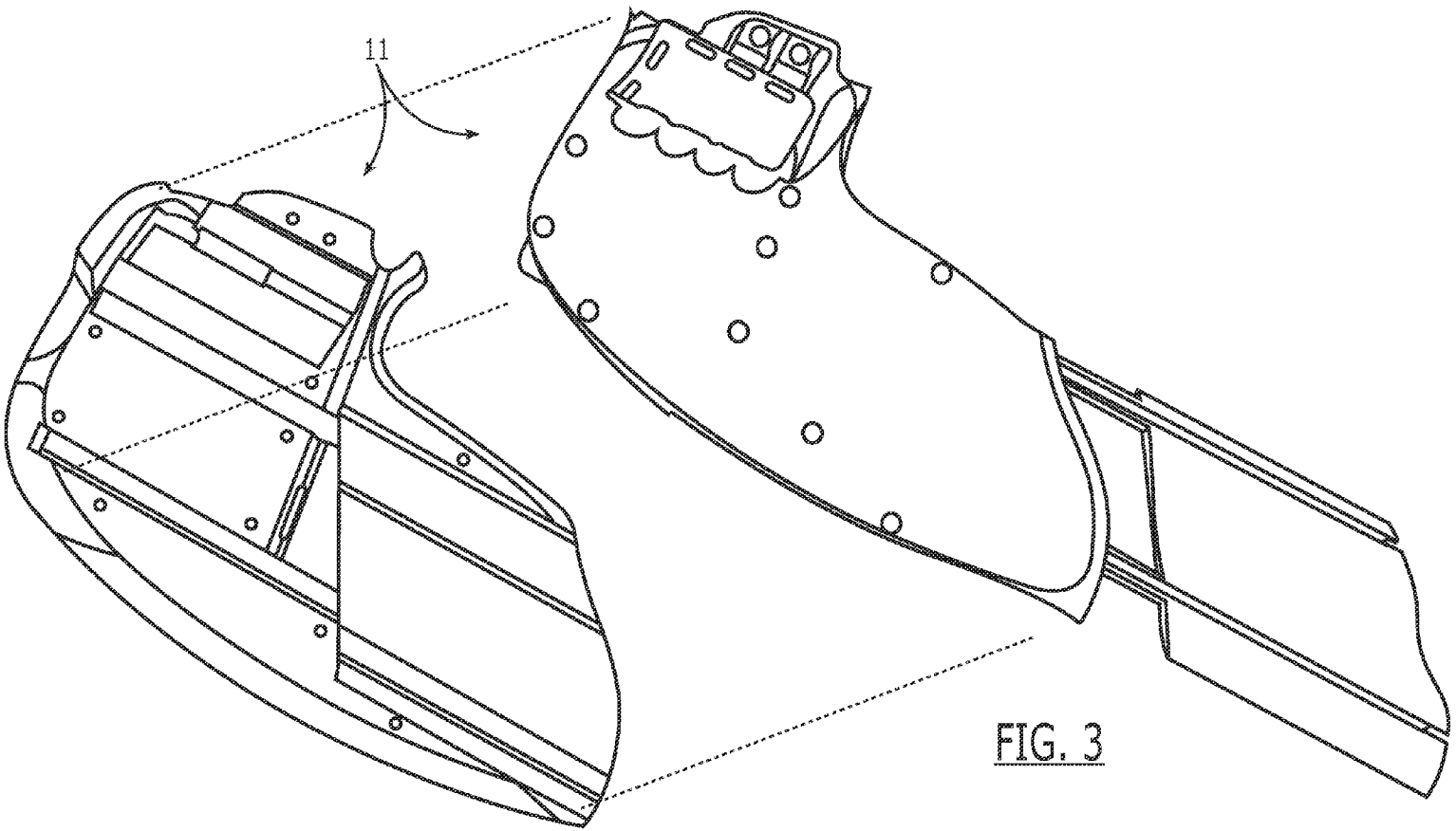
Figure 4:
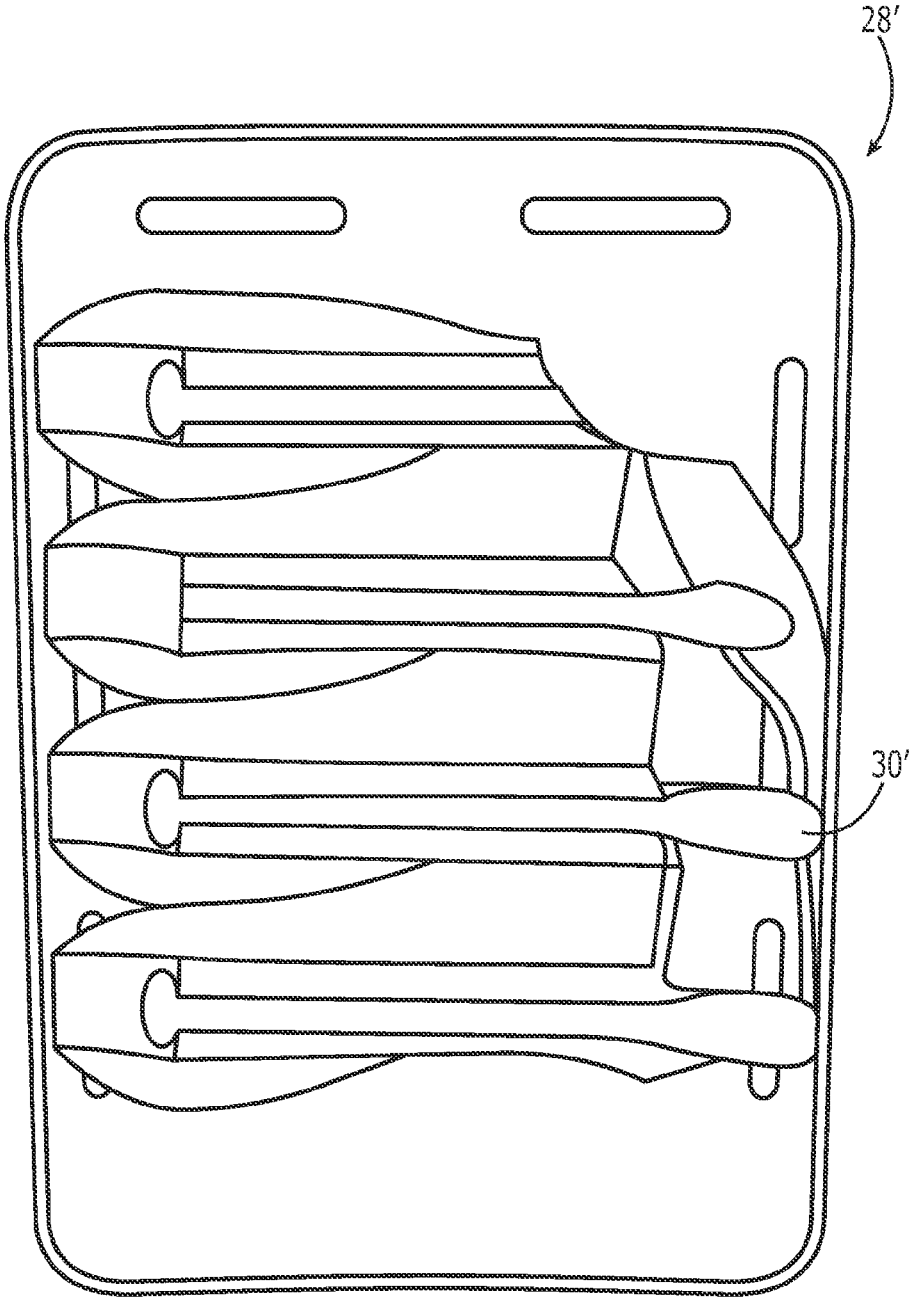
FIG. 4 is an alternate embodiment of a thigh base.

A description of the preferred embodiments will now be presented with reference to FIGS. 1-16.

A first embodiment of a device 10 (FIGS. 1-3 and 5-7) and method are provided for enhancing body surfing. The device 10 comprises a left and a right upper fin element 11. The upper fin elements 11 are substantially mirror images of each other, and left upper fin element 11 will be discussed in detail herein. Each upper fin element 11 is affixable to a respective left and right thigh of a person, as will be discussed in the following.

Left upper fin element 11 has a top edge 12 that is positionable beneath a waist of the person. The top edge 12 can be substantially linear or can be arcuate to accommodate the person's waist curvature. The upper fin element 11 also has an inner edge 13 having a top portion 14 that is substantially perpendicular to the body portion's top edge 12 and is also substantially linear. The inner edge 13 flares inwardly 15 and then proceeds outward along a portion 16 substantially parallel to the top edge 12 to accommodate the person's knee. Along a lower portion 17, the inner edge 13 proceeds generally downward to meet a bottom edge 18. The bottom edge 18 curves downward toward an outer edge 19. The bottom edge 18 can be substantially linear or arcuate.

An outer edge 19 of the upper fin 11, which can be beveled in a preferred embodiment, is substantially perpendicular to the top edge 12, with a slight outward curvature.

The upper fin 11 has a length 20 adapted to span approximately at least a length of the person's leg, and preferably approximately ⅔ of the leg. The upper fin 11 has a width 21 adjacent top edge 12 greater than a width 22 adjacent the bottom edge 18.

The upper fin element 11 is affixable to a person's thigh by means known in the art. For example, the upper fin 11 can be affixed to straps extendable about the thigh, the straps affixable via, for example, hook-and-loop-type material.

The upper fin element 11 is also affixable to the waist with the use of, for example, a belt rail 23 having a track 24 therein. A strap, similar to element 25, can be threaded through an aperture 26 secured to the belt rail 24 via a slider 27, connecting to the aperture in the upper fin, which permits rotation of the upper fin 11 relative to the waist.

Figure 5:
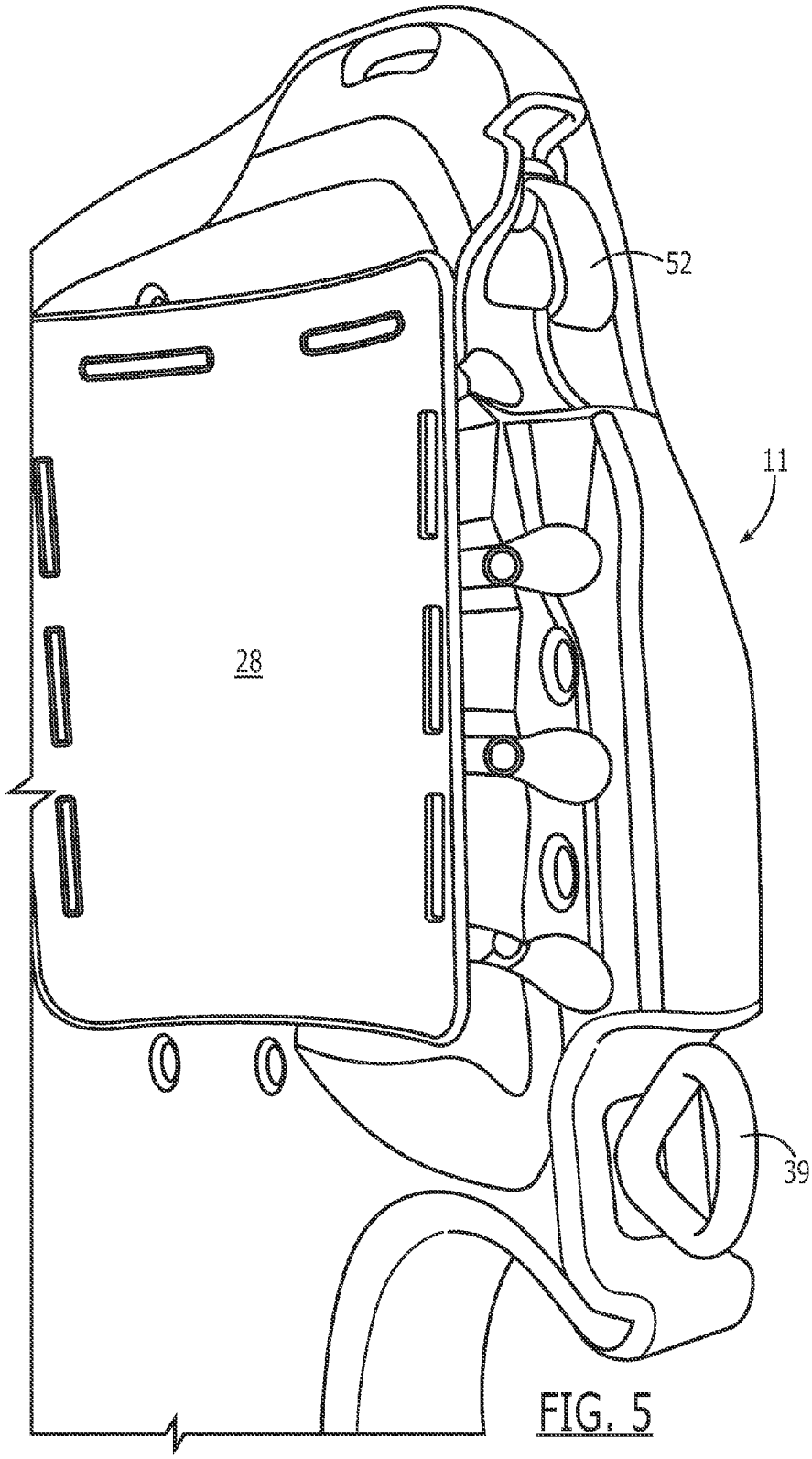
FIG. 5 is an inner side view of the device of FIG. 1.
Figure 5A:
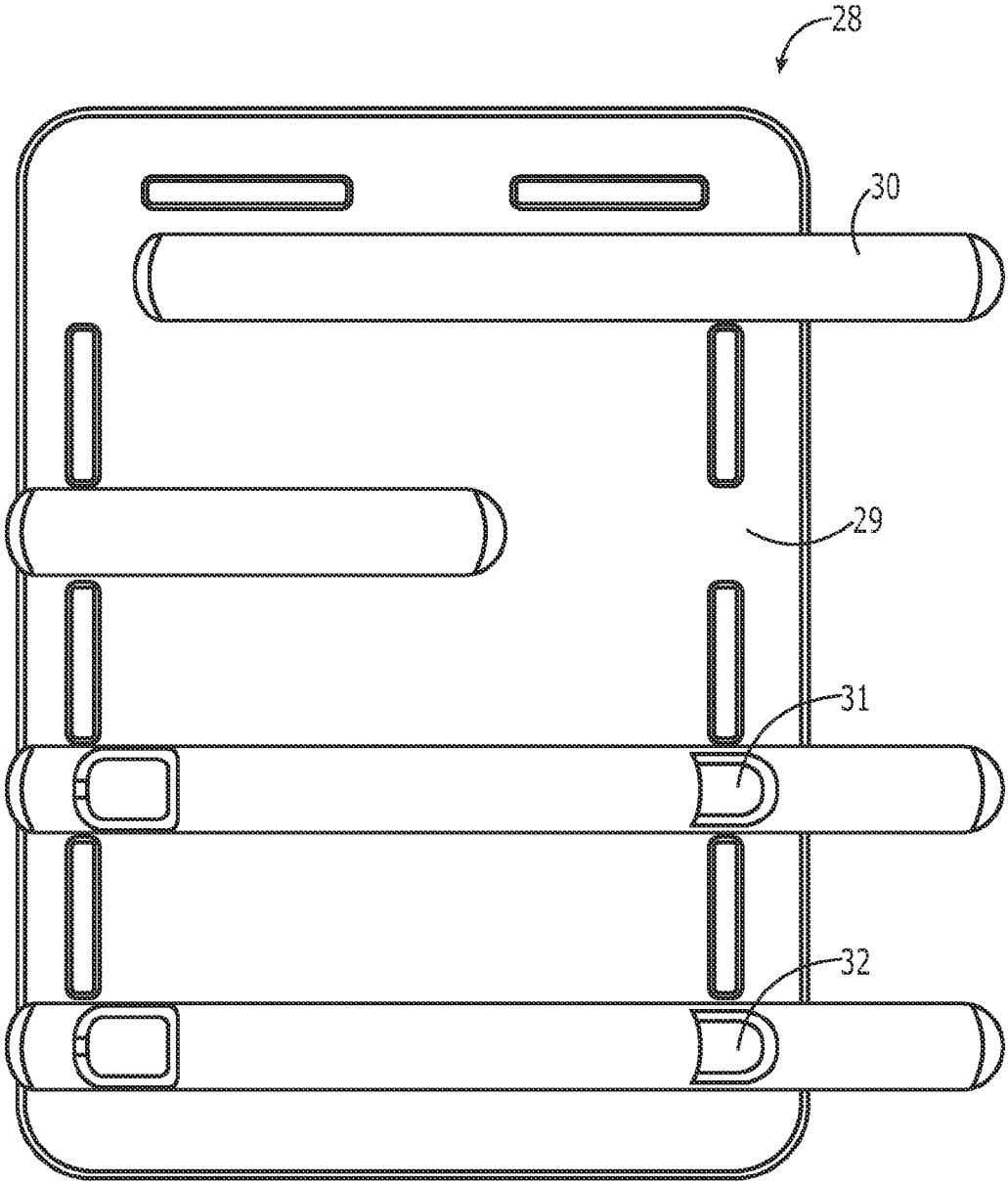
FIG. 5A is a plan view of a thigh base for the body surfing enhancement device of FIG. 1.
Figure 6:
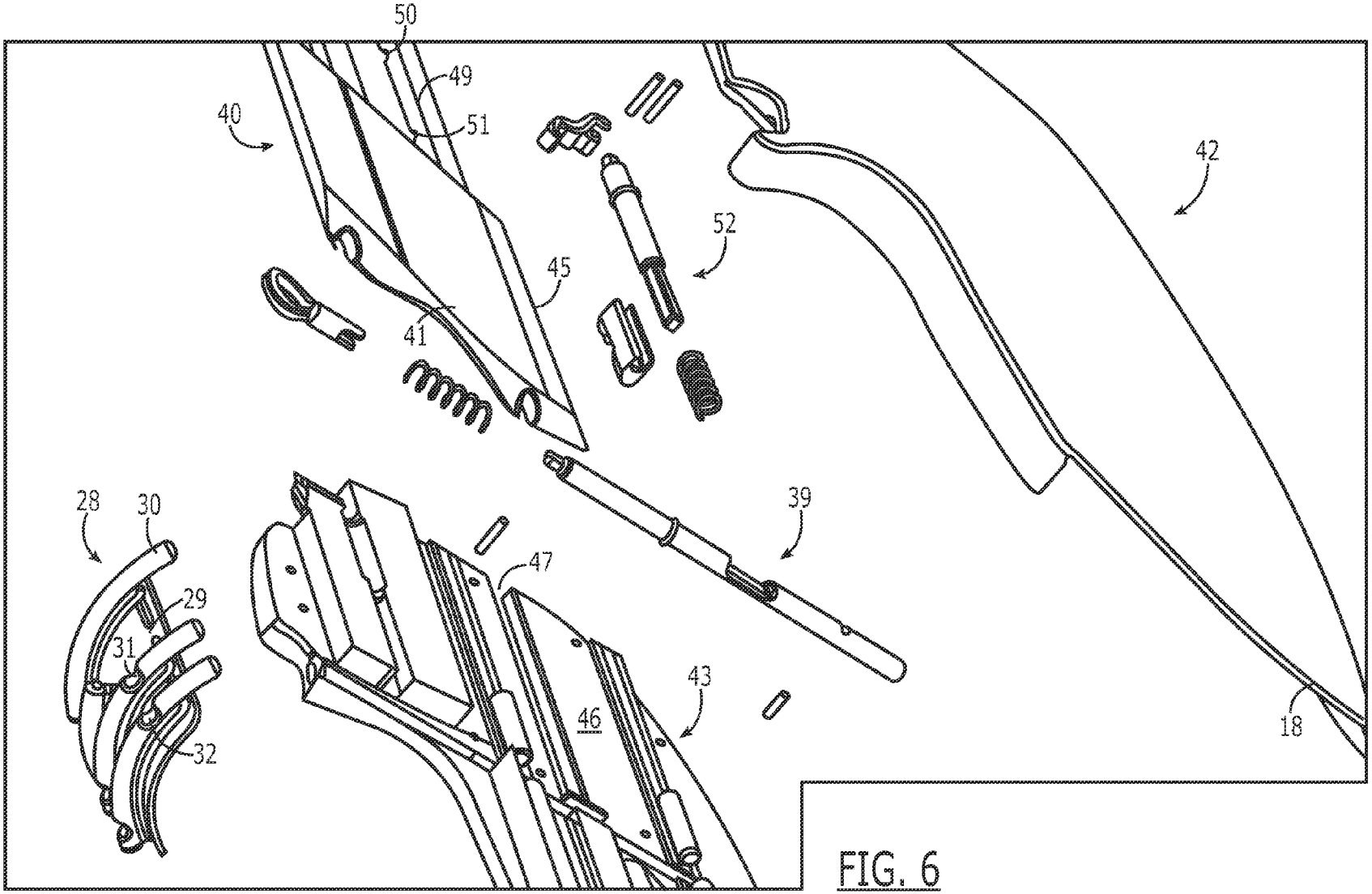
FIGS. 6 and 7 are exploded views of all the elements of the device of FIG. 1.

In a preferred embodiment, rotation relative to the thigh is achieved with the use of a guide assembly 28 affixable to the thigh via, for example, a sleeve. The guide assembly 28 (FIGS. 5A and 6) comprises an arcuate base 29 shaped to conform to the thigh. At least one guide element, here, four curved rods 30 that are substantially parallel and spaced apart, extend circumferentially around at least a portion of the base 29. At least two rods 30 comprise two fixation elements spaced apart circumferentially.

In a particular embodiment, the fixation elements comprise a pair of spaced-apart cutouts 31,32 in two of the rods 30 extending along the longitudinal axis of the leg. The cutouts 31 on one rod 30 are longitudinally aligned with the corresponding cutouts 32 on the second rod 30.

The upper fin 11 is removably anchorable to at least two of the rods 30, for permitting upper fin 11 rotational positioning relative to the longitudinal axis at a plurality of orientations thereto, at least one of the orientations comprising the upper fin 11 substantially parallel to a torso plane of the person.

In a preferred embodiment, the upper fin 11 has guide mating portion 34 (FIG. 7) that has an arcuate rear surface 35. The guide mating portion 34 has a first 36*a* and a second 36*b* track therein that are dimensioned for slidably admitting the first and the second rods 30 thereinto. The first 36*a* and the second 36*b* tracks have pair of spaced-apart, longitudinally extending holes 37 therethrough. A spacing 38 between the holes 37 is dimensioned for alignment with the guide element cutouts 31,32.

In an alternate embodiment, a guide assembly 28' (FIG. 4) comprises an opposite mating from that 28 discussed above, wherein barrels 30' are provided in lieu of the rods 30.

A spring-loaded pin 52 is affixed to the upper fin 11. The pin 52 is positioned to align with the cutouts 31,32 and the track holes 37. The pin 52 is movable between a first position threading the cutouts 31,32 and holes 37 and a second position disengaged from the holes 37 and at least the cutouts 31,32 in one of the first 36*a* and the second 36*b* track. The pin 52 is biased to the first position.

The device 10 further comprises a lower fin 40 that is slidably engaged with the upper fin 11. The lower fin 40 is longitudinally movable between a stowed position wherein a lower edge 41 thereof substantially aligns with the upper fin's bottom edge 18 and a deployed position at least partially beneath the upper fin 11.

In a particular embodiment, the upper fin 11 comprises an outer 42 and an inner 43 fin sector. These sectors 42,43 have a substantially common profile and a space 44 therebetween that is dimensioned for storing the lower fin 40 in the stowed position.

The outer edge 19 of the upper fin 11 and an outer edge 45 of the lower 40 fin, when affixed to the person, extend substantially parallel to the leg's longitudinal axis 33.

An outer surface 46 of the inner fin sector 43 has a pair of longitudinally extending, spaced-apart tracks 47. Each track 47 has a hole 48 extending laterally therethrough in spaced relation from the top edge 12, the holes 48 in longitudinal alignment.

The lower fin 40 has a pair of longitudinally extending, spaced-apart rails 49 extending from the top edge 41. The rails 49 are dimensioned and positioned for riding within the corresponding upper fin tracks 47. Each rail 49 has a pair of spaced-apart, longitudinally aligned grooves 50,51 extending laterally therethrough. A top groove 50 of each pair is positioned at a distance from the top edge 41 substantially equal to a distance between the upper fin track hole 48 and top edge 12. A bottom groove 51 of each pair is positioned to align approximately with the inner edge's parallel portion 16.

A spring-loaded locking pin 39 is threadable laterally through the track holes 48 and along one pair of lower fin rail grooves 50,51, for securing the lower fin 40 in one of the stowed position and the deployed position.

Figure 16:
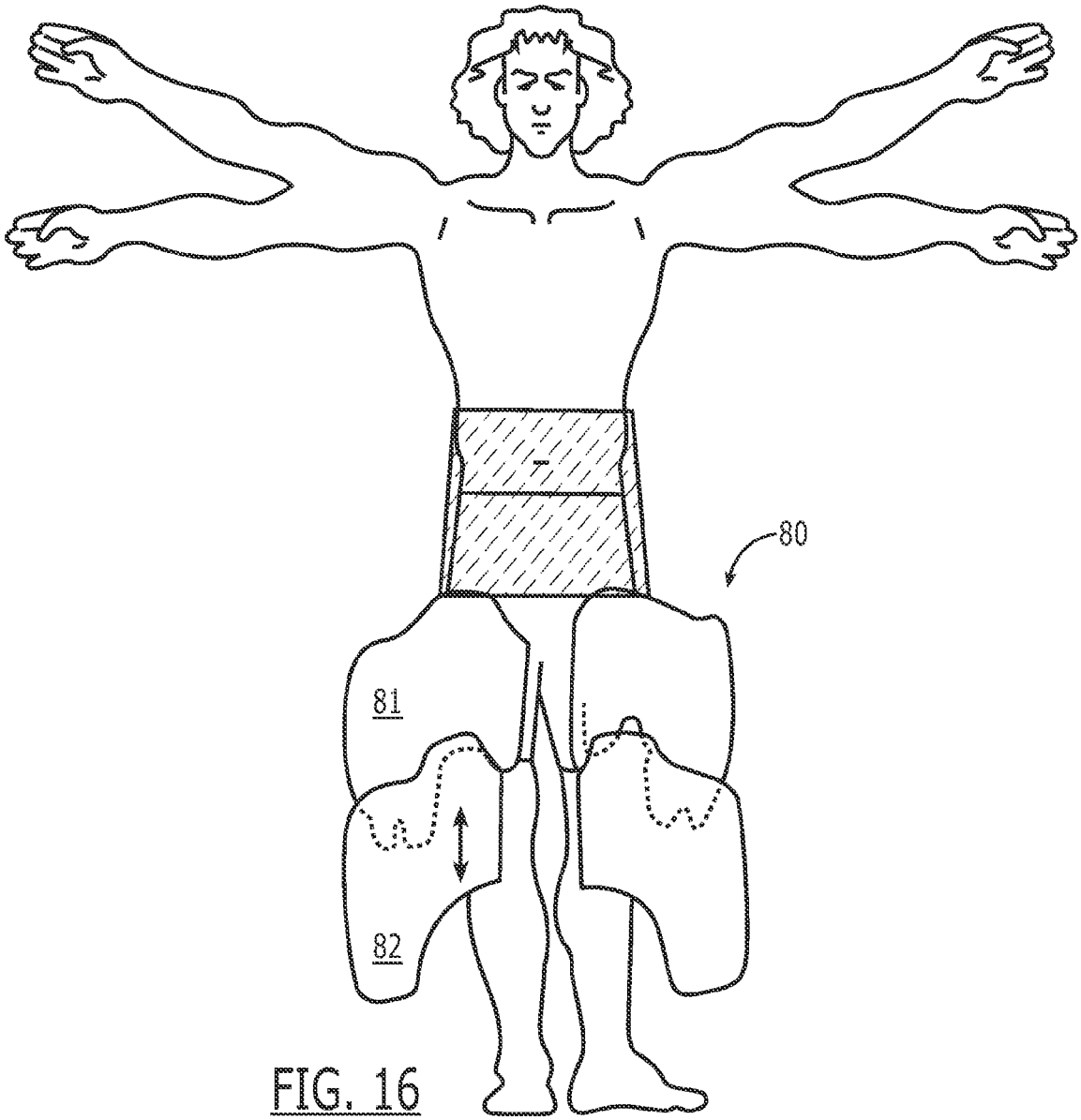
FIG. 16 is a front view of a body-surfing device having a top, longitudinally sliding one-piece upper fin.

It will be understood by one of skill in the art that an embodiment 80 could be contemplated wherein the upper fin 81 comprises a unitary base piece, and the lower fin 82 is stowable outwardly thereof and slidable downwardly in a deployed position (FIG. 16 by, for example, mating tracks and rails as discussed above.

In an embodiment, the upper 11 and lower 40 fin elements can be movable axially for folding toward the leg.

In some embodiments, at least one additional fin can be provided that extends perpendicularly in a forward direction from at least one of the fin elements, and preferably from at least the lower fin element. Such an additional fin can assist in steering and act as a "skeg."

An additional embodiment 60 comprises a unitary, monolithic fin element 61 that is affixable to the user's waist and/or legs (FIGS. 8-12). In the embodiment shown, the fin element 61 is affixed to the waist by means of a belt, and is slidable relative thereto from a closed to an extended position.

Left fin element 61 has a top edge 62 that is positionable beneath a waist of the person. The fin element 61 has an inner edge 63, a bottom edge 64, and an outer edge 65 shaped similarly to those of the upper fin 11 of the previously discussed device 10. The dimensions can also be similar, or, alternatively, the length can be sufficient to span a distance commensurate with a length between a person's waist and ankles, or any intermediate length.

The fin element 61 is affixable to a person's thigh by means known in the art. For example, the fin 61 can be affixed to straps extendable about the thigh, the straps affixable via, for example, hook-and-loop-type material.

The fin element 61 is also affixable to the waist with the use of, for example, a belt rail as discussed above.

Figure 7:
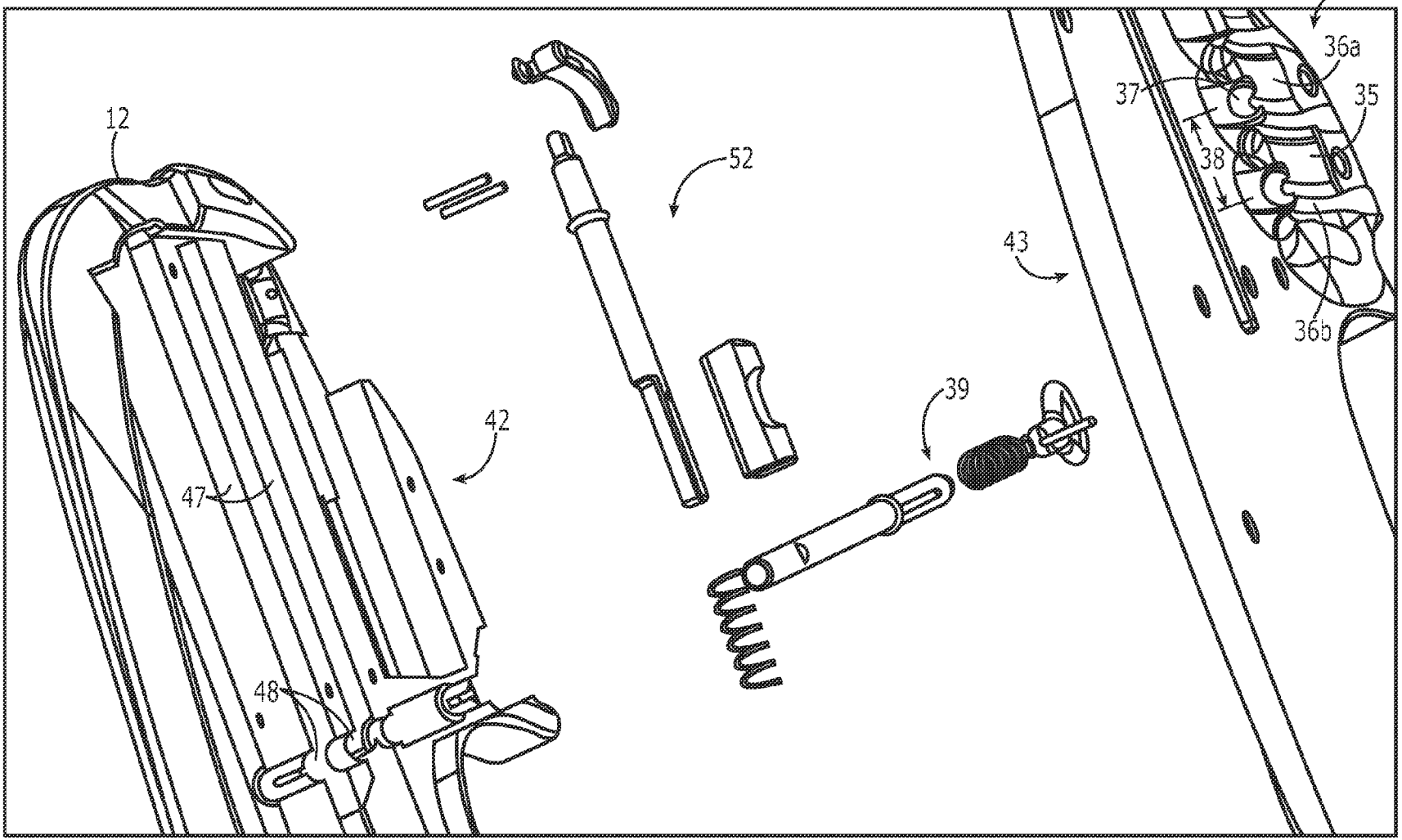
Figure 8:
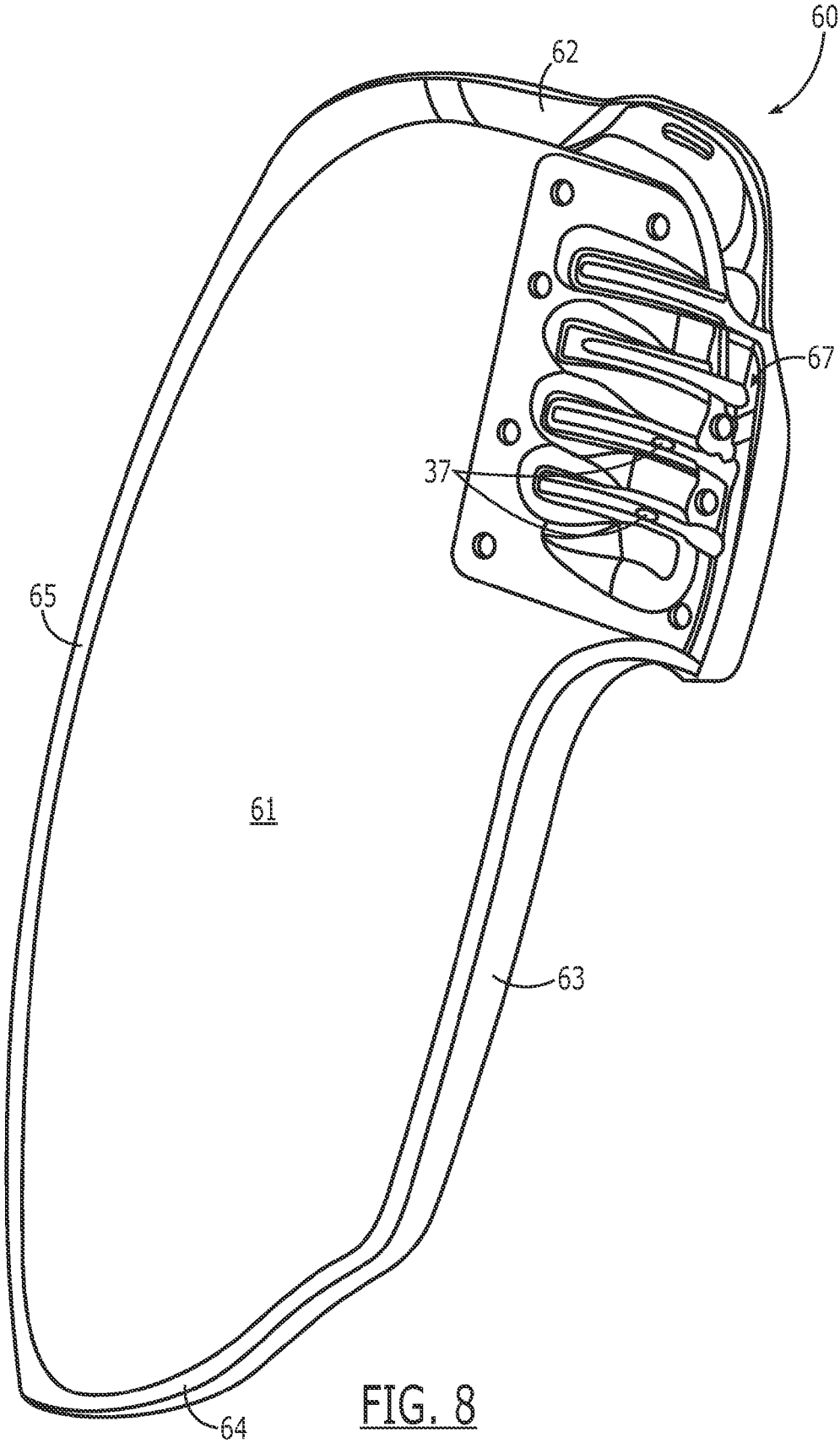
FIG. 8 is an inner plan view of a mono-fin of the present invention.
Figure 9:
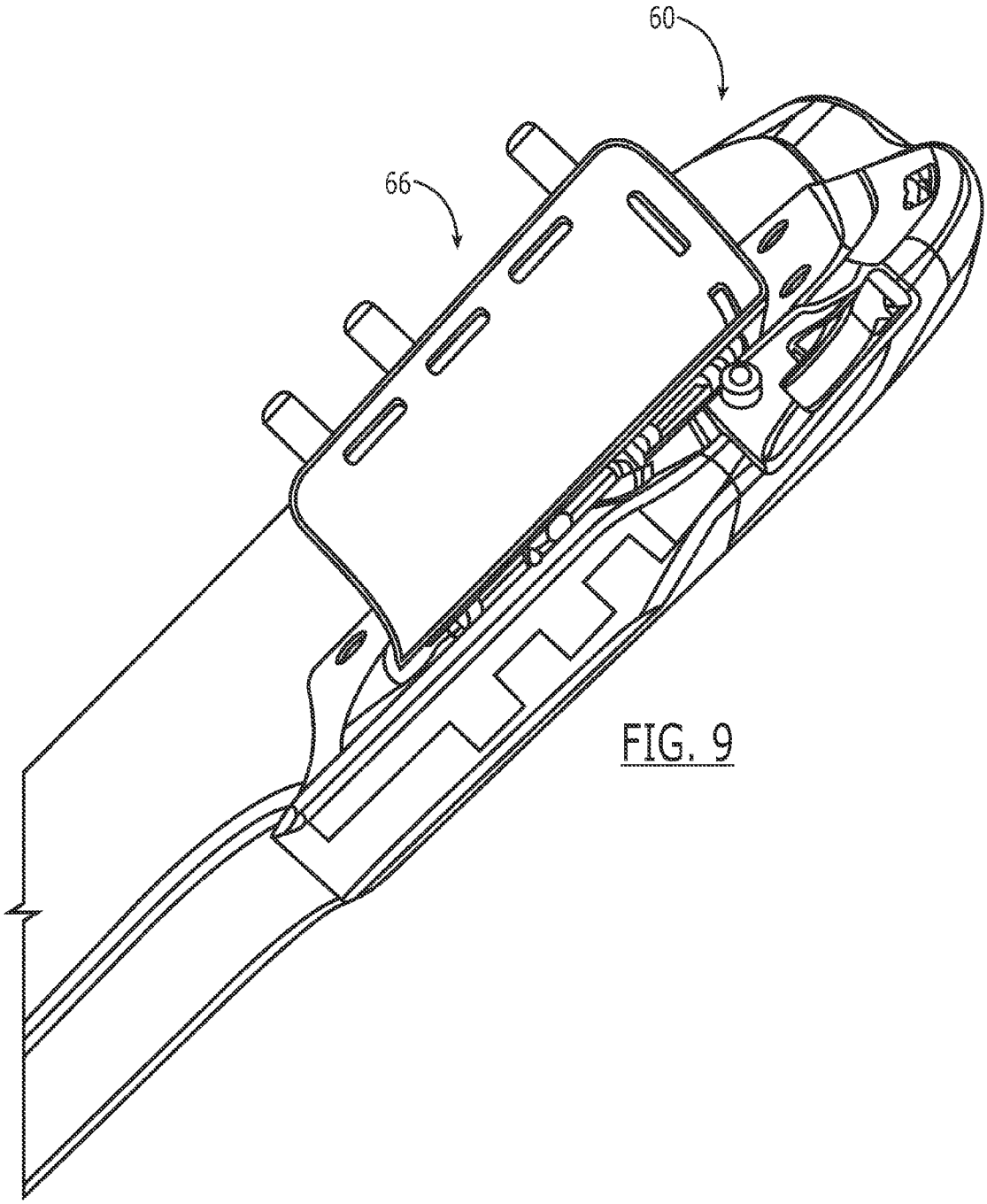
FIG. 9 is an inner perspective view of the mono-fin of FIG. 8.
Figure 10:
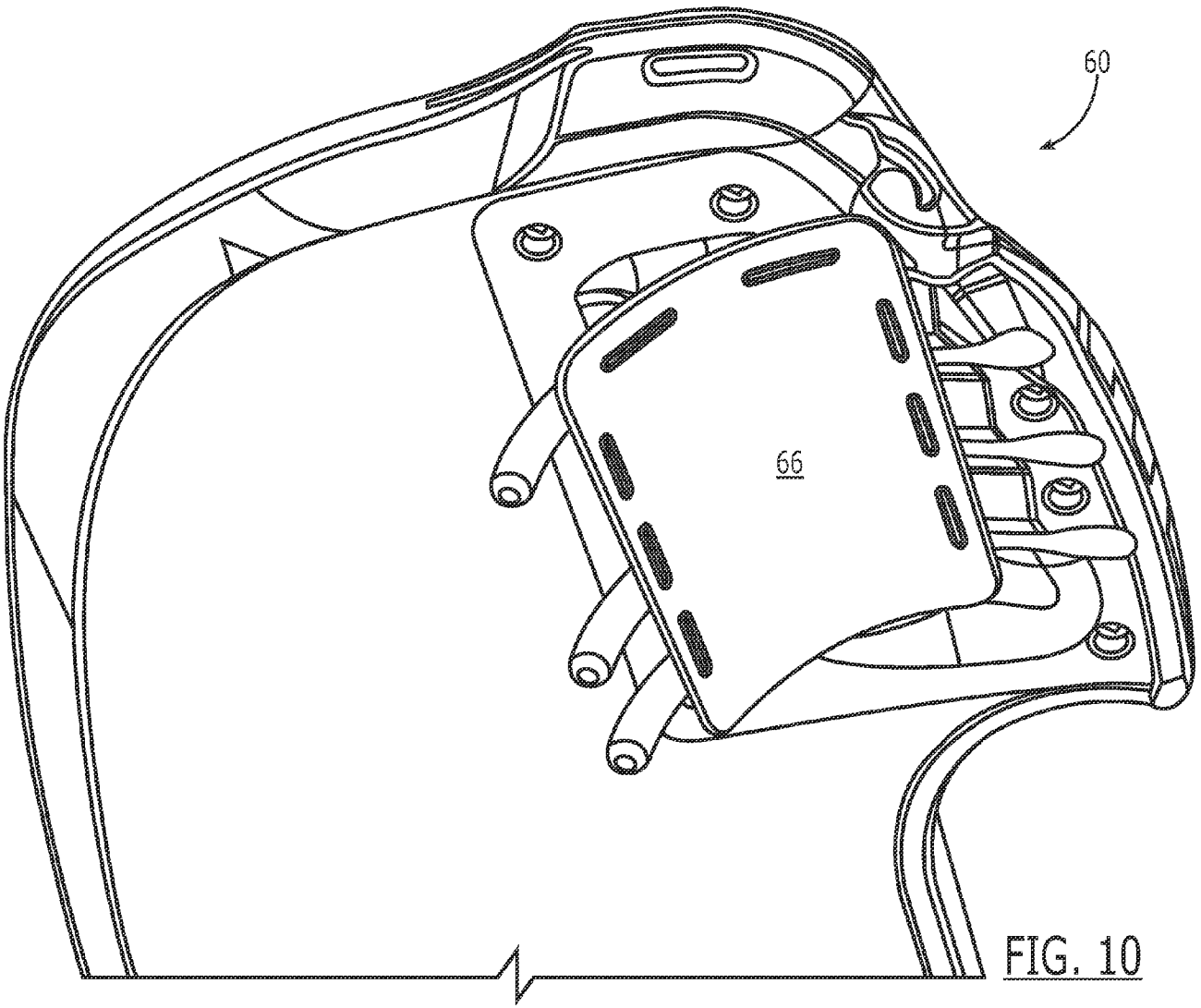
FIGS. 10 and 11 are plan views of the inner surface of the mono-fin of FIG. 8.
Figure 11:
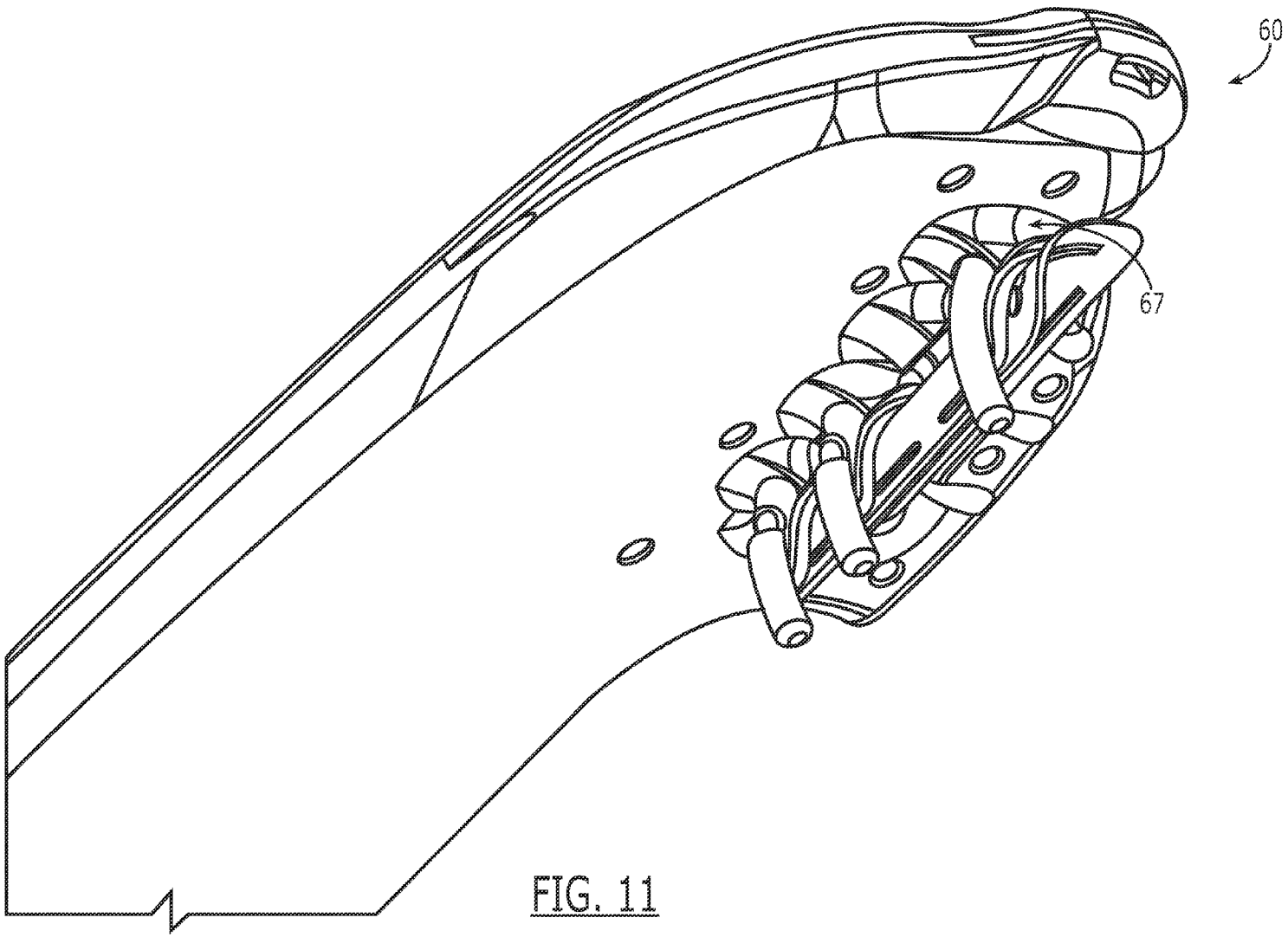
Figure 12:
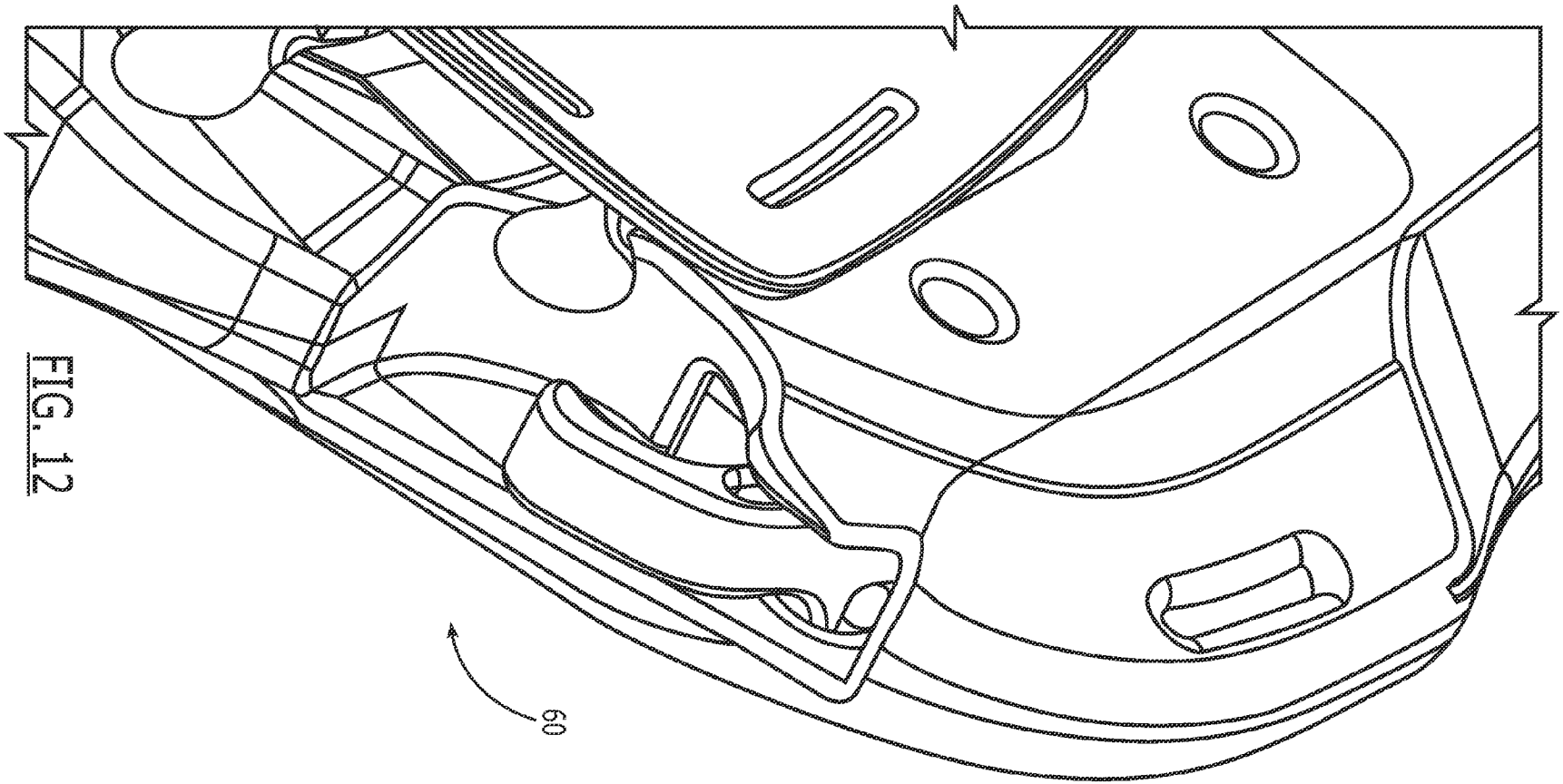
FIG. 12 is a side perspective view of the trigger for the mono-fin of FIG. 8.
Figure 13:
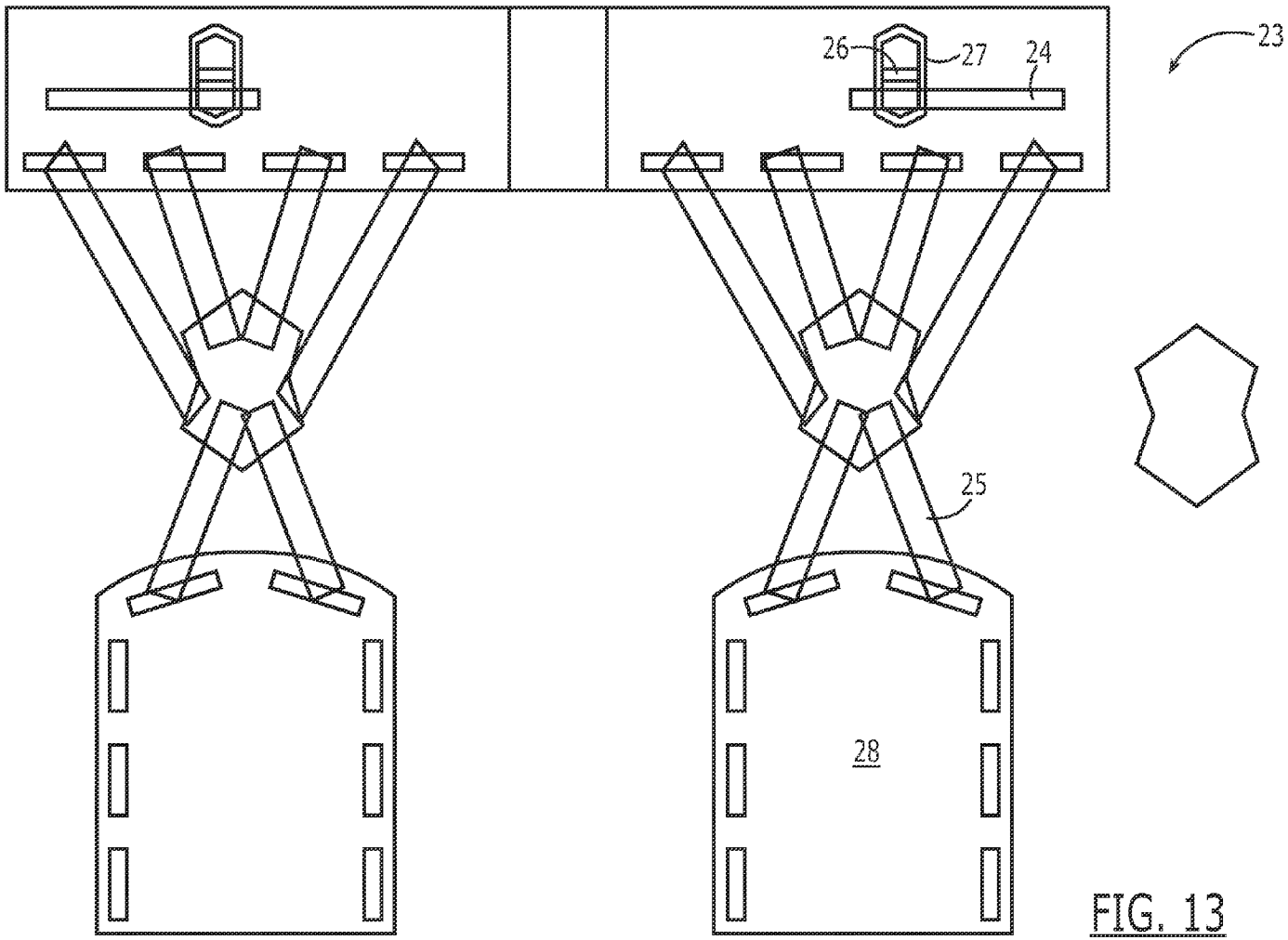
FIG. 13 is front plan view of an exemplary belt system.
Figures 14, 15:
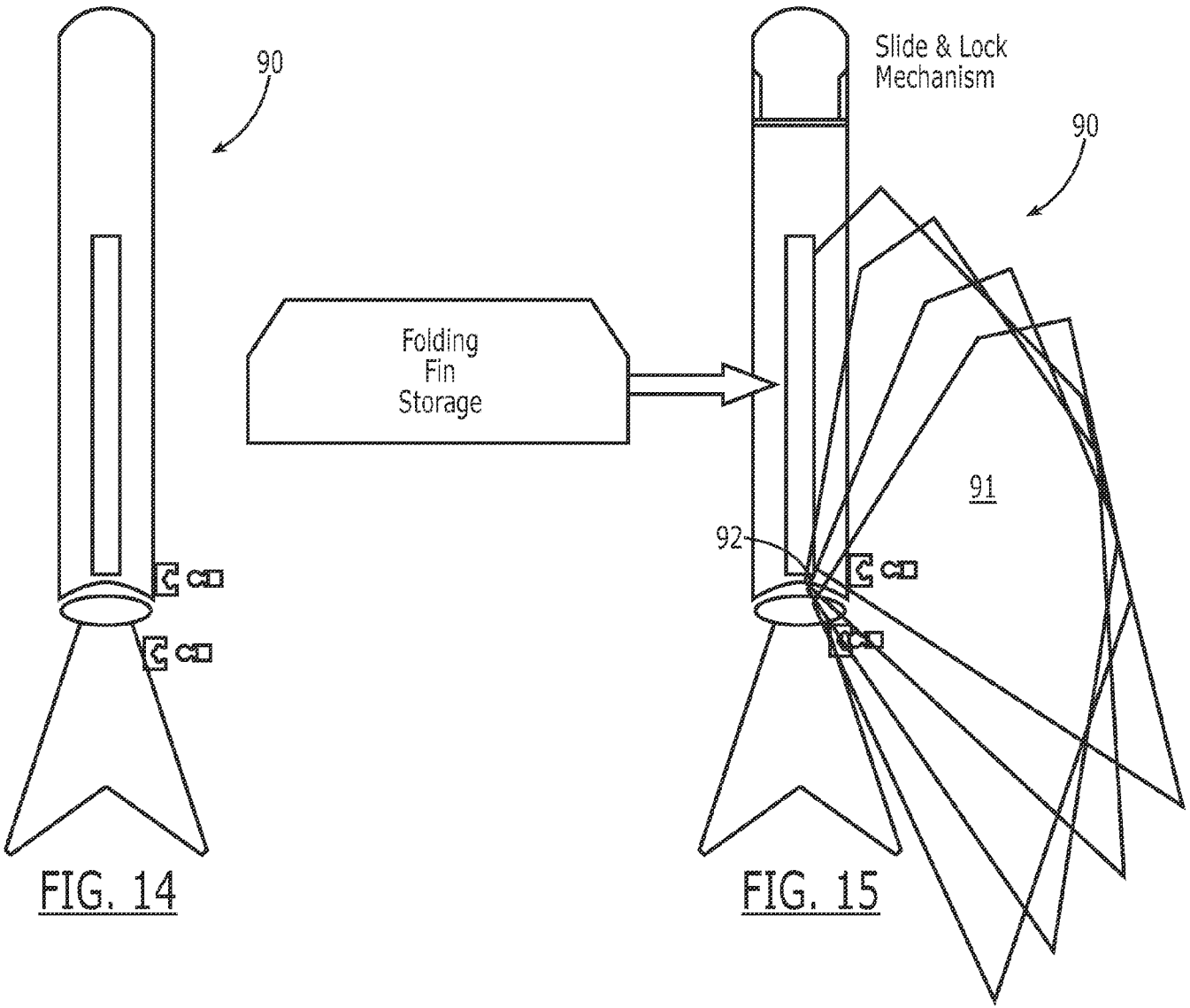
FIGS. 14 and 15 are front plan views of a foldable shin fin in the stowed (FIG. 14) and deployed (FIG. 15) positions.

In a preferred embodiment, rotation relative to the thigh is achieved with the use of a guide assembly 66 and guide mating portion 67 similar to those discussed above, with respect to element 28 in FIG. 6 and element 34 in FIG. 7.

In an embodiment, the fin element 61 can be movable axially for folding toward the leg.

A further aspect of the present invention includes a shin device 90 (FIGS. 14 and 15) having a plurality of fins 91 that are deployable in fan-like fashion by pivoting about a pivot point 92 between a stowed (FIG. 14) and a deployed (FIG. 15) position. The fins 91 when deployed extend outwardly from the shin.

Yet other embodiments may be contemplated by one of skill in the art, and the scope of the invention is not intended to be limited to the specific designs illustrated and described herein. For example, an opposed (right/left) pair of substantially rectangular, planar elements can be affixed to a person, in co-planar alignment with the torso. Such planar elements could in some embodiments be slidable outwardly from a position close to the body to a position extending away from the body. The planar elements could extend, for example, from adjacent the waist to ankle height.

In use, an embodiment of the device is affixed to the user's legs. Preferably swim fins are also donned. The device has been found to help raise the user's chest out of the water when body surfing, thereby enabling the body to act more like a surf board.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A device for use in body surfing comprising a left and a right fin element, each affixable to a respective left and right leg of a person, each having:

a guide assembly affixable to a thigh of the leg, comprising an arcuate base and at least one guide element extending circumferentially around at least a portion of the base, the base affixable to a front portion of the thigh, each guide element comprising at least two fixation elements spaced apart circumferentially;

a belt rail having a track therein and positionable adjacent a waist of the person;

an upper fin having a top edge positionable beneath the waist, the upper fin slidably affixable to the belt rail adjacent the top edge and removably anchorable to at least two of the fixation elements, for permitting upper fin rotational positioning relative to a longitudinal axis of the leg at a plurality of orientations thereto, at least one of the orientations comprising the upper fin substantially parallel to a torso plane of the person; and a lower fin slidably engaged with the upper fin and longitudinally movable between a stowed position wherein a top edge thereof substantially aligns with the upper fin top edge and a deployed position at least partially beneath the upper fin; wherein:

the upper fin has an inner edge having a top portion extending from the top edge, the top portion substantially parallel to the outer edge, and an arcuate bottom portion adjacent the top portion, the bottom portion flaring outward, so that a width along the top portion is greater than a width along the bottom portion; wherein the the guide element comprises a first and a second guide element affixed in substantially parallel, spaced-apart orientation to the base, and the fixation elements comprise a pair of spaced-apart cutouts extending along the longitudinal axis, the cutouts on the first guide element longitudinally aligned with the corresponding cutouts on the second guide element;

the upper fin has an arcuate rear surface having a first and a second track therein dimensioned for slidably admitting the first and the second guide elements thereinto, the first and the second track having pair of spaced-apart, longitudinally extending holes therethrough, a spacing between the holes dimensioned for alignment with the guide element cutouts; and the device further comprises a spring-loaded pin affixed to the upper fin, the pins positioned to align with the cutouts and the upper fin holes and movable between a first position threading the cutouts and holes and a second position disengaged from the holes and at least the cutouts in one of the first and the second track, the pins biased to the first position.

2. The device recited in claim 1, wherein the guide assembly is affixable to a sleeve having a shape conformable to, and retainable about, the thigh.

3. The device recited in claim 1, further comprising a slide piece affixable to the upper fin adjacent the top edge thereof, the slide piece dimensioned for riding within the belt rail track.

4. The device recited in claim 1, wherein:

the upper fin has a pair of longitudinally extending, spaced-apart tracks on a surface thereof, each track having a hole extending laterally therethrough in spaced relation from the top edge, the holes in longitudinal alignment;

the lower fin has a pair of longitudinally extending, spaced-apart rails extending from the top edge thereof, dimensioned and positioned for riding within the corresponding upper fin tracks, each rail having a pair of spaced-apart, longitudinally aligned grooves extending laterally therethrough, a top groove of each pair positioned at a distance from the top edge substantially equal to a distance between the upper fin track hole and top edge, a bottom groove of each pair positioned to align approximately with a bottom of the inner edge top portion; and further comprising:

a locking pin threadable laterally through the track holes and along one pair of lower fin rail grooves, for securing the lower fin in one of the stowed position and the deployed position.

5. The device recited in claim 1, wherein the upper fin comprises an outer and an inner fin sector having a substantially common profile and a space therebetween dimensioned for storing the lower fin in the stowed position.

6. A device for use in body surfing comprising a left and a right fin element, each affixable to a respective left and right leg of a person, each having:

a guide assembly affixable to a thigh of the leg, comprising an arcuate base and at least one guide element extending circumferentially around at least a portion of the base, the base affixable to a front portion of the thigh, each guide element comprising at least two fixation elements spaced apart circumferentially;

a belt rail having a track therein and positionable adjacent a waist of the person; and a fin having a top edge positionable beneath the waist, the fin slidably affixable to the belt rail adjacent the top edge and removably anchorable to at least two of the fixation elements, for permitting fin rotational positioning relative to a longitudinal axis of the leg at a plurality of orientations thereto, at least one of the orientations comprising the fin substantially parallel to a torso plane of the person, the fin having an inner edge having a top portion extending from the top edge, the top portion substantially parallel to the outer edge, and an arcuate bottom portion adjacent the top portion, the bottom portion flaring outward, so that a width along the top portion is greater than a width along the bottom portion; and wherein the guide element comprises a first and a second guide element affixed in substantially parallel, spaced-apart orientation to the base, and the fixation elements comprise a pair of spaced-apart cutouts extending along the longitudinal axis, the cutouts on the first guide element longitudinally aligned with the corresponding cutouts on the second guide element;

the fin has an arcuate rear surface having a first and a second track therein dimensioned for slidably admitting the first and the second guide elements thereinto, the first and the second track having pair of spaced-apart, longitudinally extending holes therethrough, a spacing between the holes dimensioned for alignment with the guide element cutouts; and the device further comprises a spring-loaded pin affixed to the upper fin, the pins positioned to align with the cutouts and the fin holes and movable between a first position threading the cutouts and holes and a second position disengaged from the holes and at least the cutouts in one of the first and the second track, the pins biased to the first position.

7. The device recited in claim 6, wherein the guide assembly is affixable to a sleeve having a shape conformable to, and retainable about, the thigh.

8. The device recited in claim 6, further comprising a slide piece affixable to the upper fin adjacent the top edge thereof, the slide piece dimensioned for riding within the belt rail track.

9. A method of enhancing a body-surfing experience comprising:

affixing a left and a right guide assembly to, respectively, a left and a right thigh of the leg, each guide assembly comprising an arcuate base and at least one guide element extending circumferentially around at least a portion of the arcuate base, the arcuate base affixable to a front portion of each thigh, each guide element comprising at least two fixation elements spaced apart circumferentially;

affixing a belt rail having a track therein adjacent a waist of the person;

rotating a left fin device and a right fin device for circumferential rotation relative to and about each of the left and the right thighs by slidably affixing each of the left fin device and the right fin devices to the respective left and right guide element and the belt rail, each of the left and the right fin devices comprising an upper fin and a lower fin;

slidably affixing each of the left and the right upper fins to the belt rail;

vertically sliding the left and the right lower fins downward relative to the left and the right upper fins from a stowed position wherein a top edge thereof substantially aligns with a top edge of the left and the right upper fins to a deployed position; wherein:

securing the left and the right upper fins in a desired orientation and securing the left and the right lower fins in the deployed position.

10. A method of enhancing a body-surfing experience comprising:

affixing a left and a right guide assembly to, respectively, a left and a right thigh of the leg, each guide assembly comprising an arcuate base and at least one guide element extending circumferentially around at least a portion of the arcuate base, the arcuate base affixable to a front portion of the thigh, each guide element comprising at least two curved rods that are substantially parallel and spaced apart that extend circumferentially around a portion of the arcuate base;

affixing a belt rail having a track therein adjacent a waist of the person;

providing a left fin device with an upper end and a lower end:

providing a right fin device with an upper end and a lower end;

rotating both the upper end and the lower end of the left fin device and the upper end and the lower end of the right fin device for circumferential rotation relative to and about each of the left and the right thighs by slidably affixing the left and the right fin devices to the respective left and right guide elements and the belt rail;

slidably affixing each of the left and the right fin devices to the belt rail; and securing the left and the right fin devices in a desired orientation.

11. A device for use in body surfing comprising a left and a right fin element, each affixable to a respective left and right leg of a person, each having:

a guide assembly affixable to a thigh of the leg, comprising an arcuate base and at least one guide element extending circumferentially around at least a portion of the base, the base affixable to a front portion of the thigh, each guide element comprising at least two fixation elements spaced apart circumferentially;

a belt rail having a track therein and positionable adjacent a waist of the person;

an upper fin having a top edge positionable beneath the waist, the upper fin slidably affixable to the belt rail adjacent the top edge and removably anchorable to at least two of the fixation elements, for permitting upper fin rotational positioning relative to a longitudinal axis of the leg at a plurality of orientations thereto, at least one of the orientations comprising the upper fin substantially parallel to a torso plane of the person; and a lower fin slidably engaged with the upper fin and longitudinally movable between a stowed position wherein a top edge thereof substantially aligns with the upper fin top edge and a deployed position at least partially beneath the upper fin; wherein:

the upper fin has an inner edge having a top portion extending from the top edge, the top portion substantially parallel to the outer edge, and an arcuate bottom portion adjacent the top portion, the bottom portion flaring outward, so that a width along the top portion is greater than a width along the bottom portion; wherein:

the upper fin has a pair of longitudinally extending, spaced-apart tracks on a surface thereof, each track having a hole extending laterally therethrough in spaced relation from the top edge, the holes in longitudinal alignment;

the lower fin has a pair of longitudinally extending, spaced-apart rails extending from the top edge thereof, dimensioned and positioned for riding within the corresponding upper fin tracks, each rail having a pair of spaced-apart, longitudinally aligned grooves extending laterally therethrough, a top groove of each pair positioned at a distance from the top edge substantially equal to a distance between the upper fin track hole and top edge, a bottom groove of each pair positioned to align approximately with a bottom of the inner edge top portion; and further comprising:

a locking pin threadable laterally through the track holes and along one pair of lower fin rail grooves, for securing the lower fin in one of the stowed position and the deployed position.

* * * * *